US009539704B2

(12) United States Patent
Bao

(10) Patent No.: US 9,539,704 B2
(45) **Date of Patent: *Jan. 10, 2017**

(54) CARBONATE PCD AND METHODS OF MAKING THE SAME

(71) Applicant: SMITH INTERNATIONAL, INC., Houston, TX (US)

(72) Inventor: Yahua Bao, Orem, UT (US)

(73) Assignee: Smith International, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/209,768

(22) Filed: Mar. 13, 2014

(65) Prior Publication Data

US 2014/0259963 A1 Sep. 18, 2014

Related U.S. Application Data

(60) Provisional application No. 61/801,182, filed on Mar. 15, 2013, provisional application No. 61/843,655, filed on Jul. 8, 2013.

(51) Int. Cl.

| | |
|---|---|
| ***B24D 3/00*** | (2006.01) |
| ***B24D 3/02*** | (2006.01) |
| ***B24D 11/00*** | (2006.01) |
| ***B24D 18/00*** | (2006.01) |
| ***C09K 3/14*** | (2006.01) |
| ***B24D 99/00*** | (2010.01) |

(52) U.S. Cl.

CPC ..... *B24D 99/005* (2013.01); *B24D 18/0009* (2013.01)

(58) Field of Classification Search

USPC ..... 51/309, 293, 307

See application file for complete search history.

(56) References Cited

U.S. PATENT DOCUMENTS

| | | | |
|---|---|---|---|
| 5,624,756 | A | 4/1997 | Ueda et al. |
| 6,068,913 | A | 5/2000 | Cho et al. |
| 8,323,367 | B1 | 12/2012 | Bertagnolli et al. |
| 8,342,269 | B1 | 1/2013 | Bertagnolli et al. |

(Continued)

OTHER PUBLICATIONS

"Drill bits comprising superabrasive cutting elements formed from polycrystalline diamond and methods of forming same", IP.com Prior Art Database Disclosure Number: IPCOM000158151D, Sep. 17, 2007.

(Continued)

*Primary Examiner* — James McDonough

(57) ABSTRACT

A polycrystalline diamond body, and a method for making a carbonate polycrystalline diamond body includes combining a first quantity of diamond particles with a first quantity of magnesium carbonate to form a first layer in an enclosure, the first layer having a working surface, and placing a second quantity of magnesium carbonate in the enclosure forming a second layer, the first layer and the second layer forming an assembly. A quantity of at least one of silicon or aluminum is mixed in with or placed adjacent to at least one of the first layer or the second layer. The assembly, including the at least one of silicon or aluminum, is sintered at high pressure and high temperature, causing the at least one of silicon or aluminum to infiltrate at least one layer of the assembly, forming a polycrystalline diamond body.

13 Claims, 9 Drawing Sheets

(56) References Cited

U.S. PATENT DOCUMENTS

| | | | | |
|---|---|---|---|---|
| 8,353,974 | B2 | 1/2013 | Cooley et al. | |
| 8,365,846 | B2 | 2/2013 | Dourfaye et al. | |
| 2005/0050801 | A1 | 3/2005 | Cho et al. | |
| 2006/0060391 | A1 | 3/2006 | Eyre et al. | |
| 2010/0242375 | A1* | 9/2010 | Hall | B22F 3/14 51/307 |
| 2010/0243337 | A1 | 9/2010 | Scott | |
| 2011/0023375 | A1 | 2/2011 | Sani et al. | |
| 2011/0031034 | A1 | 2/2011 | Digiovanni et al. | |
| 2011/0061942 | A1 | 3/2011 | Digiovanni | |
| 2011/0252713 | A1 | 10/2011 | Chakraborty et al. | |
| 2011/0297453 | A1 | 12/2011 | Mukhopadhyay et al. | |
| 2012/0102843 | A1 | 5/2012 | Chakraborty et al. | |
| 2012/0241224 | A1* | 9/2012 | Qian | B22F 5/00 175/428 |
| 2013/0043078 | A1 | 2/2013 | Qian et al. | |

OTHER PUBLICATIONS

Arima, et al., "Diamond nucleation and growth by reduction of carbonate melts under high-pressure and high-temperature conditions", Geology, vol. 30 (8), 2002, p. 691-694.

International Search Report and Written Opinion issued in PCT/US2014/027770 on Jul. 10, 2014, 17 pages.

First Office Action issued in related CN application 201480016011.7 on May 25, 2016, 17 pages.

* cited by examiner

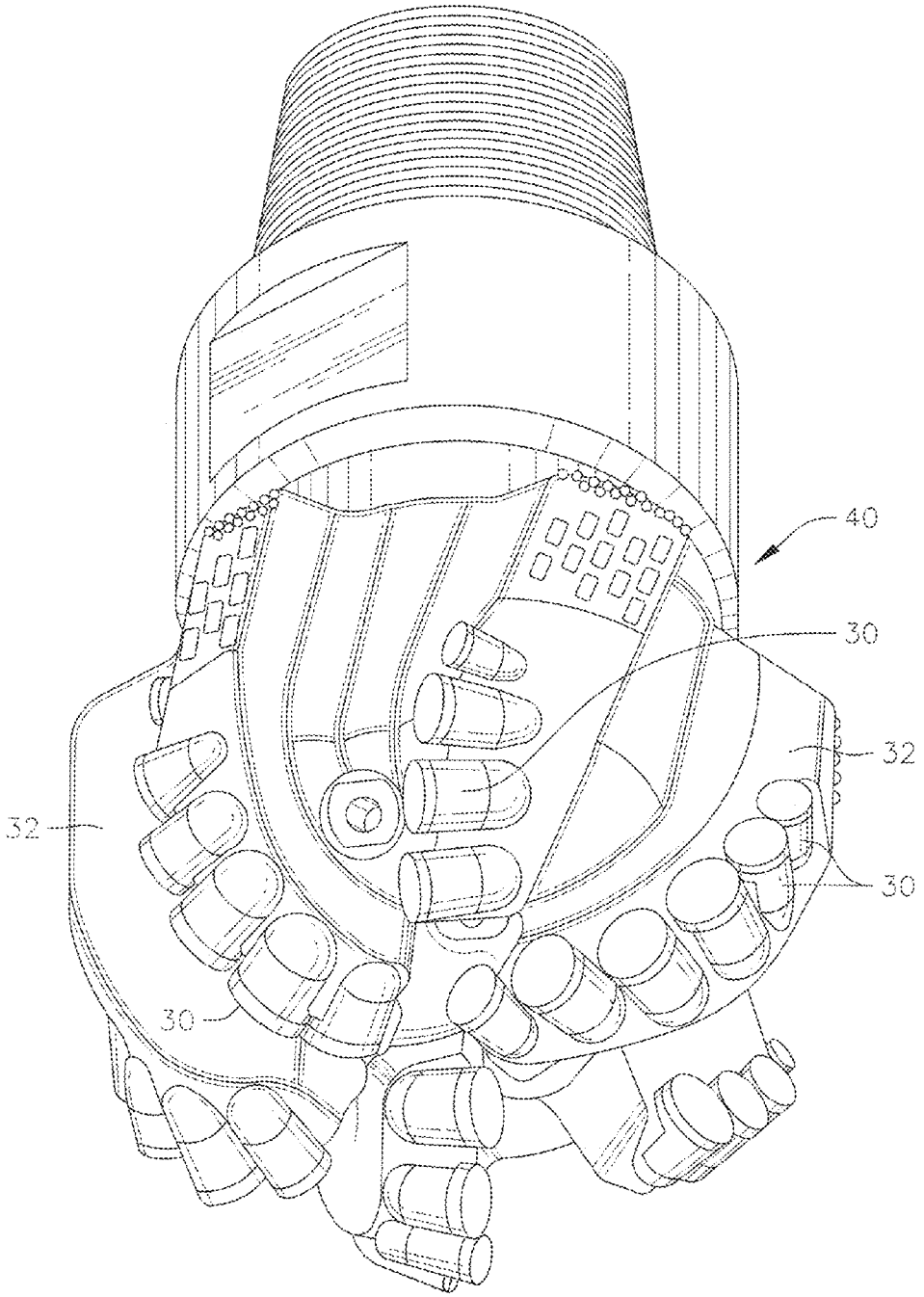
40
30
32
32
30
30

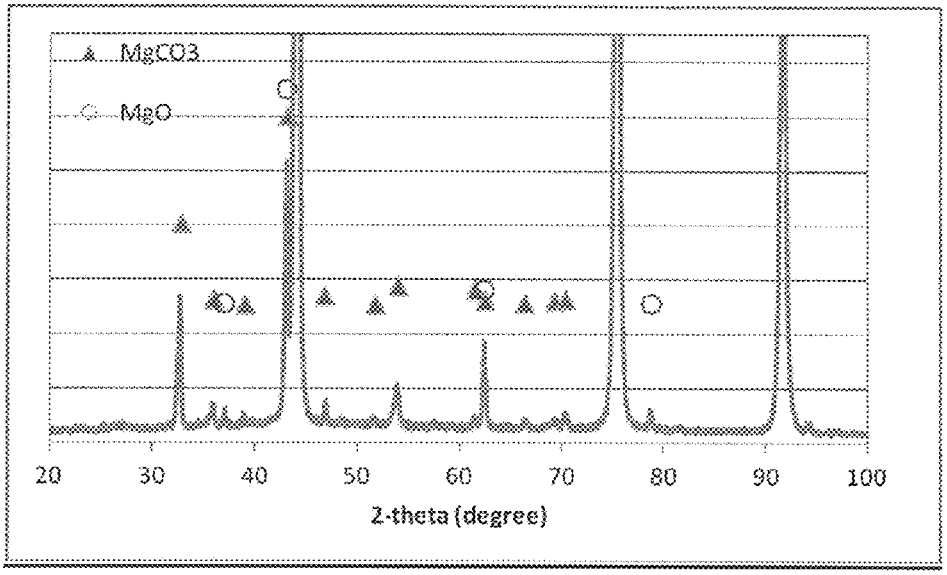
*FIG. 7*
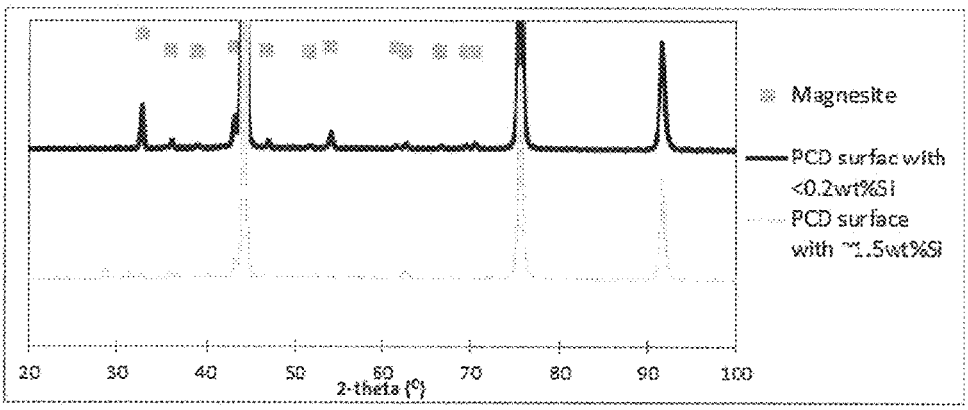

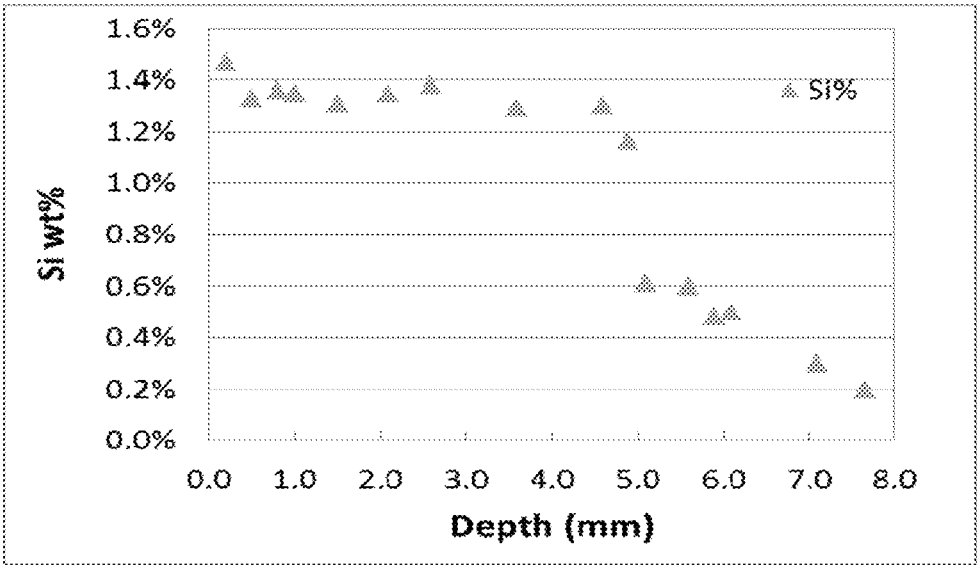
*FIG. 9*
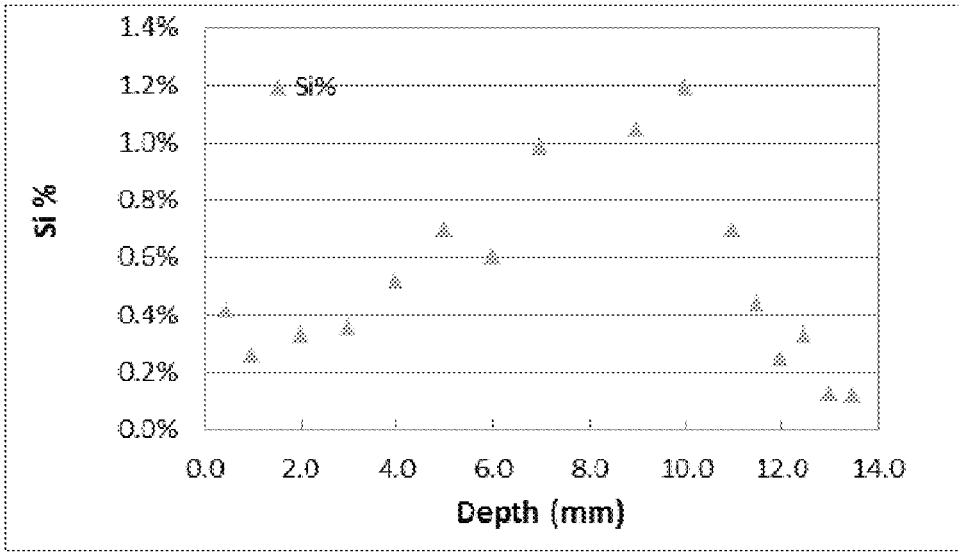

CARBONATE PCD AND METHODS OF MAKING THE SAME

CROSS-REFERENCE TO RELATED APPLICATIONS

This application claims the benefit of U.S. Provisional Patent Application Ser. No. 61/801,182 filed on Mar. 15, 2013, entitled, "CARBONATE PCD WITH A DISTRIBUTION OF SI AND/OR AI ELEMENTS" to inventor Yahua Bao; and U.S. Provisional Patent Application Ser. No. 61/843,655 filed on Jul. 8, 2013, entitled "CARBONATE PCD WITH A DISTRIBUTION OF SI AND/OR AL ELEMENTS" to inventor Yahua Bao; the entire contents of both are fully incorporated herein by reference.

BACKGROUND

Ultra-hard materials are often used in cutting tools and rock drilling tools. Polycrystalline diamond material is one such ultra-hard material, and is known for its good wear resistance and hardness. To form polycrystalline diamond, diamond particles are sintered at high pressure and high temperature (HPHT sintering), as for example at pressure equal to or greater than 50 kbar and temperature equal or great than 1350° C., to produce an ultra-hard polycrystalline structure. A catalyst material is added to the diamond particle mixture prior to HPHT sintering and/or infiltrates the diamond particle mixture during HPHT sintering in order to promote the intergrowth of the diamond crystals during HPHT sintering, to form the polycrystalline diamond (PCD) structure. Metals conventionally employed as the catalyst are selected from the group of solvent metal catalysts of Group VIII of the Periodic table, including cobalt, iron, and nickel, and combinations and alloys thereof. After HPHT sintering, the resulting PCD structure includes a network of interconnected diamond crystals or grains bonded to each other, with the catalyst material occupying the interstitial spaces or pores between the bonded diamond crystals. The diamond particle mixture may be HPHT sintered in the presence of a substrate, to form a PCD compact bonded to the substrate. The substrate may also act as a source of the metal catalyst that infiltrates into the diamond particle mixture during sintering.

The amount of catalyst material used to form the PCD body represents a compromise between desired properties of strength, toughness, and impact resistance versus hardness, wear resistance, and thermal stability. While a higher metal catalyst content generally increases the strength, toughness, and impact resistance of the resulting PCD body, this higher metal catalyst content also decreases the hardness and wear resistance as well as the thermal stability of the PCD body. This trade-off makes it difficult to provide a PCD having desired levels of hardness, wear resistance, thermal stability, strength, impact resistance, and toughness to meet the service demands of particular applications, such as in cutting and/or wear elements used in subterranean drilling devices.

Thermal stability can be particularly relevant during wear or cutting operations. Conventional PCD bodies may be vulnerable to thermal degradation when exposed to elevated temperatures during cutting and/or wear applications. This vulnerability results from the differential that exists between the thermal expansion characteristics of the metal catalyst disposed interstitially within the PCD body and the thermal expansion characteristics of the intercrystalline bonded diamond. This differential thermal expansion is known to start at temperatures as low as 400° C., and can induce thermal stresses that are detrimental to the intercrystalline bonding of diamond and that eventually result in the formation of cracks that can make the PCD structure vulnerable to failure. Accordingly, such behavior is not desirable.

Another form of thermal degradation known to exist with conventional PCD materials is one that is also related to the presence of the metal catalyst in the interstitial regions of the PCD body and the adherence of the metal catalyst to the diamond crystals. Specifically, the metal catalyst is known to cause an undesired catalyzed phase transformation in diamond (converting it to carbon monoxide, carbon dioxide, or graphite) with increasing temperature, thereby limiting the temperatures at which the PCD body may be used.

To improve the thermal stability of the PCD material, a carbonate catalyst has been used to form the PCD. PCD formed with a carbonate catalyst is referred to hereinafter as "carbonate PCD." The carbonate catalyst is mixed with the diamond particles prior to sintering, and promotes the growth of diamond grains during sintering. When a carbonate catalyst is used, the diamond remains stable in polycrystalline diamond form with increasing temperature, rather than being converted to carbon dioxide, carbon monoxide, or graphite. Thus the carbonate PCD is more thermally stable than PCD formed with a metal catalyst.

However, the carbonate catalyst itself is subject to a decomposition reaction with increasing temperature, converting to a metal oxide. The carbonate may be released as $CO_2$ gas, causing outgassing of the carbonate PCD material. This outgassing can cause volume expansion and undesirable voids, bubbles, or films on adjacent surfaces, leading to imperfections and cracks in the ultra-hard material as well as decreased wear resistance.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some embodiments, a carbonate polycrystalline diamond body has a working surface opposite a non-working surface. The carbonate polycrystalline diamond body includes a first layer including a material microstructure including a plurality of bonded-together diamond crystals and interstitial spaces there between, a portion of the interstitial spaces being occupied by a first quantity of a magnesium carbonate, the first layer defining the working surface. At least one of the first layer or the second layer includes at least a quantity of at least one of silicon, aluminum, or a combination thereof.

In some embodiments, a method for making a carbonate polycrystalline diamond body includes combining a first quantity of diamond particles with a first quantity of magnesium carbonate to form a first layer in an enclosure, the first layer having a working surface, and placing a second quantity of magnesium carbonate in the enclosure forming a second layer. The first layer and the second layer forming an assembly. A quantity of at least one of silicon or aluminum is mixed in with or placed adjacent to at least one of the first layer or the second layer. The method further includes sintering the assembly including the at least one of silicon or aluminum at high pressure and high temperature, causing the at least one of silicon or aluminum to infiltrate at least one layer of the assembly, forming a polycrystalline diamond body.

BRIEF DESCRIPTION OF THE DRAWINGS

Embodiments of the present disclosure are described with reference to the following figures.

FIG. 5 illustrates a perspective view of a drag bit incorporating the diamond compact element of FIG. 3*a* or 3*b*.

FIG. 6 is an X-ray diffraction pattern graph for a carbonate polycrystalline diamond layer including less than 0.2 wt % silicon, heated-treated to 1200° C. under vacuum.

FIG. 7 is an X-ray diffraction pattern graph for a carbonate polycrystalline diamond showing a layer including less than 0.2 wt % Silicon, and a layer including approximately 1.5 wt % silicon, heated-treated to 900° C. under vacuum, according to an embodiment.

FIG. 8 is a graph of the distribution of silicon along the thickness of a PCD body including a 0.5 wt % SiC compound mixed with diamond particles of both a first and a second layer of the PCD body, according to an embodiment.

FIG. 9 is a graph of the distribution of silicon along the thickness of a PCD body including an $MgCO_3$ catalyst powder containing 1.5 wt % $SiO_2$, according to an embodiment.

DETAILED DESCRIPTION

The present disclosure relates to ultra-hard materials, and more particularly in some embodiments, to ultra-hard materials formed with a carbonate catalyst having controlled thermal decomposition, and methods for forming the same. For clarity, as used herein, the term "PCD" refers to conventional polycrystalline diamond that has been formed with the use of a metal catalyst during an HPHT sintering process, forming a microstructure of bonded diamond crystals with the catalyst material occupying the interstitial spaces or pores between the bonded diamond crystals. The term "carbonate PCD" refers to PCD formed with a carbonate catalyst, forming a microstructure of bonded diamond crystals with the carbonate catalyst material occupying the interstitial spaces or pores between the bonded diamond crystals.

Figure 1:
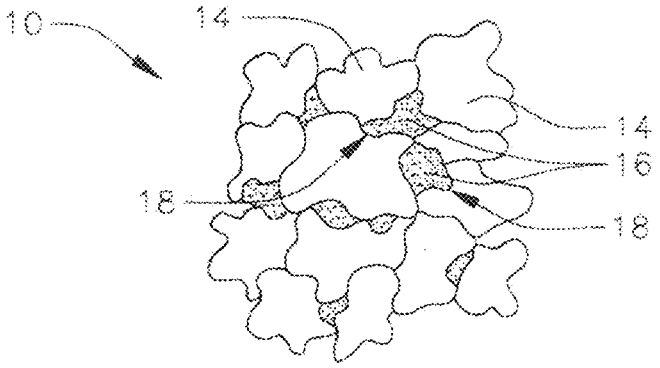
FIG. 1 illustrates a schematic view of a material microstructure of a carbonate polycrystalline diamond material according to an embodiment (where the dimensions may be exaggerated and thus the drawing may not be to scale, for clarity).

A region of a carbonate PCD material 10 is schematically illustrated in FIG. 1. The carbonate PCD material 10 has a polycrystalline microstructure including multiple diamond grains or crystals 14 bonded to each other, with interstitial spaces or pores 18 between the diamond crystals. This polycrystalline microstructure is formed by subjecting diamond particles to an HPHT sintering process in the presence of a carbonate catalyst. In some embodiments, the HPHT sintering process includes applying a pressure of about 50 kbar or greater, and a temperature of greater than 1350° C. In other embodiments, the HPHT sintering process includes applying a pressure of about 65 kbar or greater, and a temperature of greater than 1800° C. At this temperature and pressure, the carbonate catalyst material melts and infiltrates the diamond particles mixture. The catalyst promotes the direct bonding of diamond crystals during the HPHT sintering process, forming carbonate PCD. The result is a carbonate PCD material with the carbonate catalyst material 16 occupying the interstitial spaces 18 between the diamond crystals 14 (referred to hereinafter as "grains"). In some embodiments, the diamond grains 14 in the carbonate PCD material have a size in the range of 1 to 20 microns.

In some embodiments, a carbonate PCD body is formed by subjecting an ultra-hard diamond element such as a volume of diamond particles to an HPHT sintering process in the presence of a carbonate catalyst such as magnesium carbonate ($MgCO_3$). In an embodiment, the carbonate PCD body is formed by mixing diamond particles 14 with the carbonate catalyst 16 before HPHT sintering to create the carbonate PCD body. The formed carbonate PCD body is subsequently heat-treated under vacuum or at atmospheric pressure at a temperature of approximately 1100° C. to 1200° C. to convert a portion of the carbonate catalyst into an oxide, while releasing a gas. Heat treatment may occur in a furnace, such as vacuum furnace. In embodiments including a $MgCO_3$ carbonate catalyst, the oxide is magnesium oxide (MgO), while the gas is carbon dioxide ($CO_2$). In some embodiments including an $MgCO_3$ carbonate catalyst, the $MgCO_3$ carbonate catalyst contains a $SiO_2$ impurity in the range of 1.5 wt % to 1.8 wt %. In some embodiments, the $MgCO_3$ carbonate catalyst contains 1.5 wt % $SiO_2$.

Figure 3A:
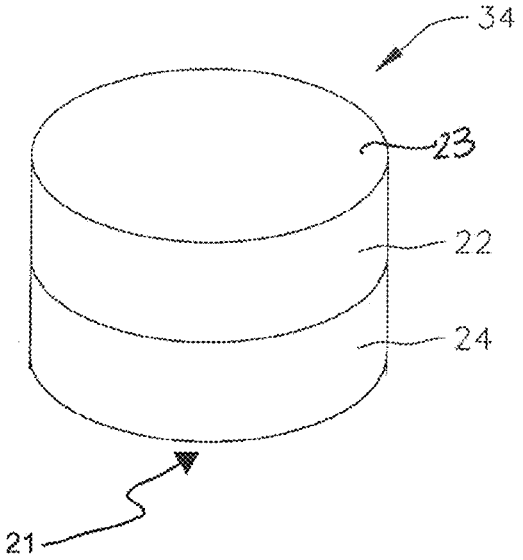
FIG. 3*a* illustrates a perspective view of the diamond compact incorporating a carbonate polycrystalline diamond body after HPHT sintering and subsequent heat treatment of an assembly including a first layer or working surface, and a second layer or non-working surface, according to an embodiment.
Figure 2A:
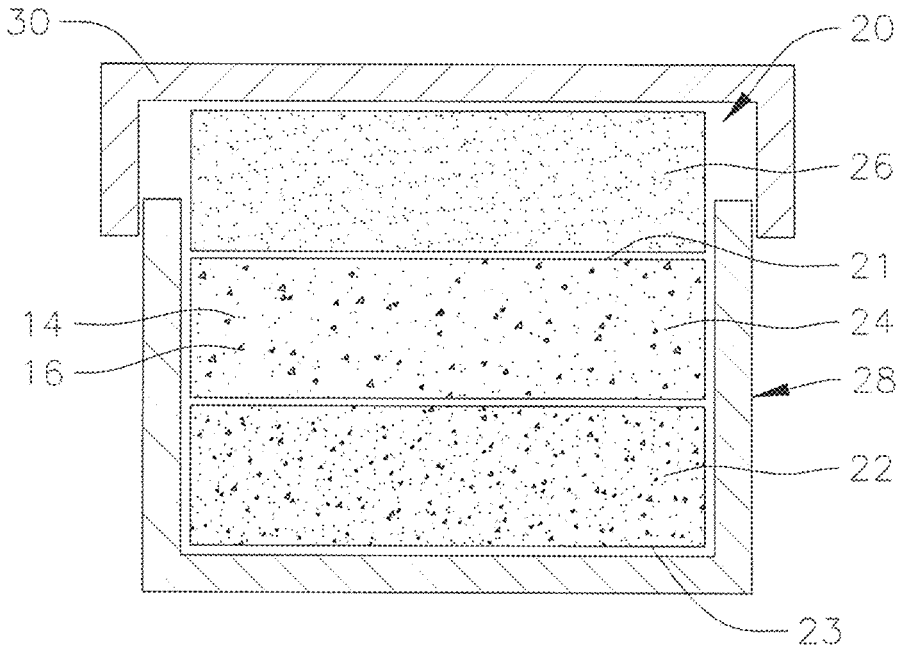
FIGS. 2*a*, 2*b* and 2*c* schematically illustrate cross-sectional views of enclosures including an assembly having a first layer, a second layer, and a third layer including a distribution of a Si and/or Al compound, prior to HPHT sintering, according to various embodiments.
Figure 2B:
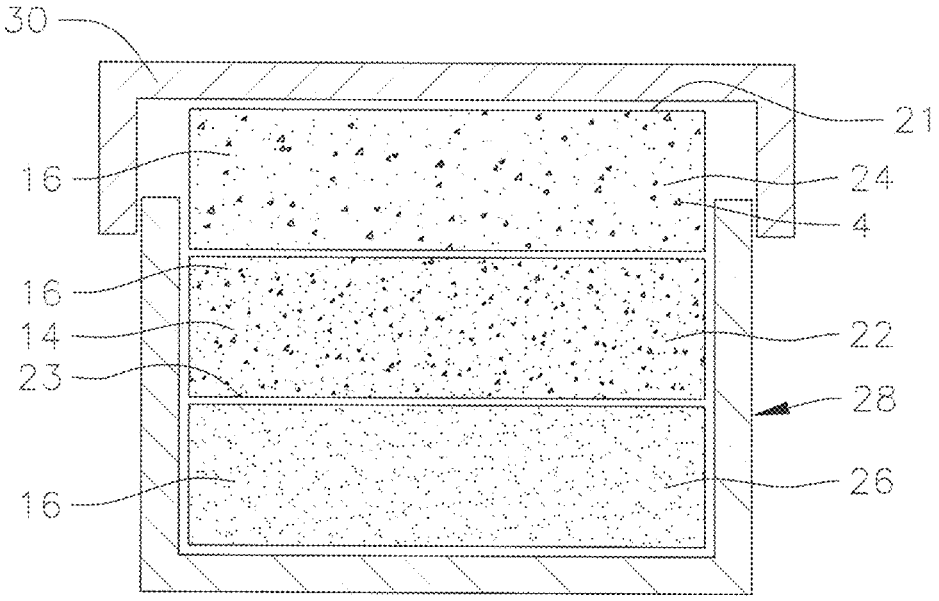
Figure 2C:
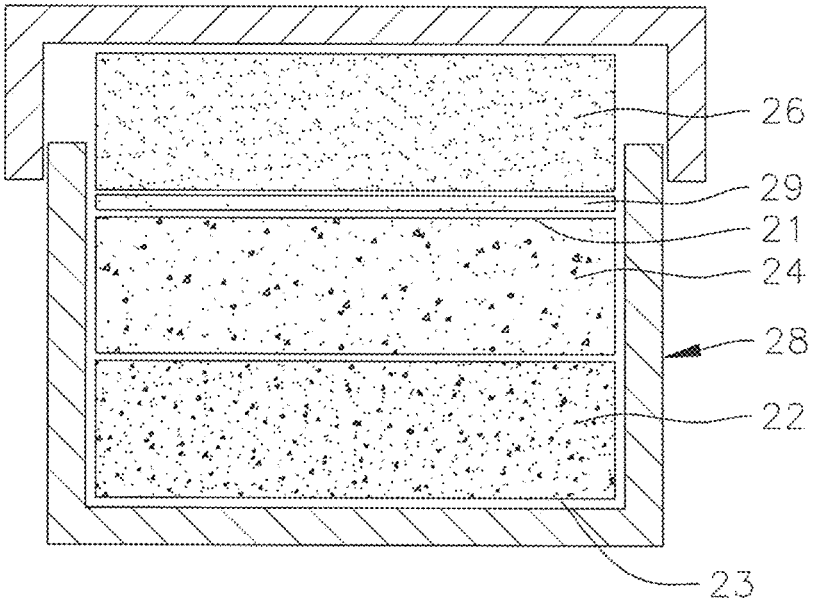
Figure 3B:
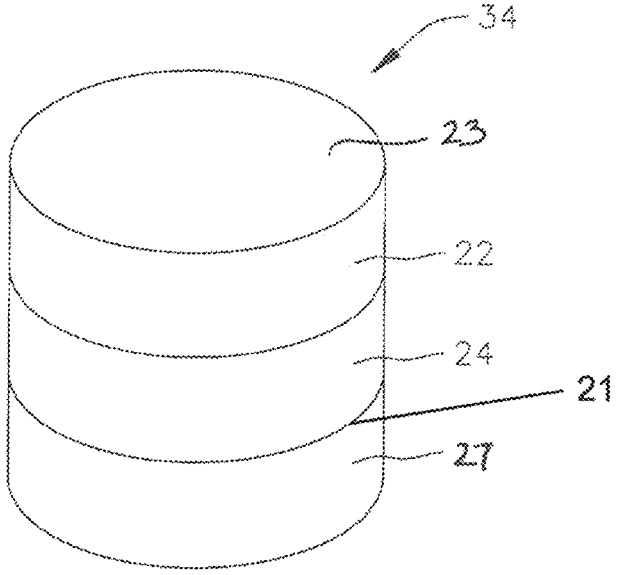
FIG. 3*b* illustrates a perspective view of the diamond compact incorporating a carbonate polycrystalline diamond body after HPHT sintering and subsequent heat treatment of the assembly illustrated in FIGS. 2*a*, 2*b* and 2*c*, including a first layer or working surface, a second layer or non-working surface, and a substrate, according to an embodiment.

With reference to FIGS. 2*a*, 2*b* and 2*c*, in some embodiments, the carbonate PCD body 20 is formed in an enclosure (which in some embodiments is a refractory can or container 28) with a series of layers 22, 24, and 26. In some embodiments, the series of layers includes a first layer 22 defining a working surface 23 at one surface of the first layer 22. In some embodiments (e.g., in most embodiments), the third layer 26 includes a carbonate catalyst without a diamond particle mixture (as for example shown in FIG. 2*b*), and is adjacent to either the working surface side 23 of the first layer 22 (FIG. 2*b*), or the non-working surface 21 side of the second layer 24 (FIG. 2*a*). In some embodiments, the series of layers includes second layer 24 including a non-working surface 21 at one surface of the second layer 24 at an opposite surface from the working surface 23 (FIG. 2*a*). The second layer 24 includes a diamond particle mixture. In some embodiments, the third layer 26 may be subdivided into a plurality of layers, and the plurality of layers of the third layer 26 may be adjacent to the second layer 24 or to the first layer 22, and may include a diamond particle mixture layer, a carbonate catalyst layer, or any combination thereof. In some embodiments, during or after HPHT sintering, the series of layers may optionally be attached to a separate substrate 27 adjacent to the non-working surface 21 (FIG. 3*b*). The refractory can or container 28 contains the series of layers 22, 24 and 26, and protects them from the surrounding environment. The refractory can or container 28 may also have a lid 30 which fits over the top end of the refractory can or container 28. The refractory can or container 28 and lid 30 are formed from a refractory metal such as niobium, molybdenum, or tantalum.

Generally, when a non-metal catalyst such as a carbonate is used in forming a carbonate PCD body, the diamond remains stable while being converted to polycrystalline diamond form during HPHT sintering with increasing temperatures up to 1200° C., without being converted to carbon dioxide, carbon monoxide, or graphite. However, during subsequent heat-treatment cycles of the formed carbonate PCD under atmospheric pressure or vacuum (after HPHT sintering) for the purpose of decomposing the carbonate catalyst, the PCD may develop cracks at temperatures between 800° C. and 1200° C., and may be subject to graphitization. This threshold temperature of 1200° C. is very close to the thermally stable temperature of PCD under vacuum. In some embodiments, by controlling the thermal decomposition of the carbonate catalyst, a crack-free working surface 23 of the carbonate PCD body is formed. Thus, in order to prevent or reduce thermal degradation of the PCD after HPHT sintering and during heat-treatment cycles below the threshold 1200° C. (ranging from temperatures between 1100° C.-1200° C.), various embodiments provide for a $MgCO_3$ carbonate catalyst that infiltrates the diamond particles during HPHT sintering and fully (or mostly) decomposes at a temperature below the 1200° C. threshold during subsequent heat-treatment cycles.

Generally, a carbonate catalyst such as $MgCO_3$ may begin to decompose at a temperature of approximately 400° C. at ambient pressure. The thermal decomposition temperature of $MgCO_3$ is related to the pressure. For example, $MgCO_3$ will remain in its major phase without fully decomposing when heat-treated after HPHT sintering for one hour under vacuum to a temperature of 1200° C., as for example shown in FIG. 6 and Table 1, below. FIG. 6 shows an X-ray diffraction pattern graph for a carbonate polycrystalline diamond layer including less than 0.2 wt % Silicon, heat-treated to 1200° C. under vacuum. Table 1, interpreting the patterns displayed in FIG. 6, demonstrates an example including a $MgCO_3$ catalyst based carbonate PCD, where the carbonate PCD assembly includes less than 0.2 wt % Si (and/or Al) heat-treated to 1200° C. under vacuum. According to this example and the data shown in Table 1, approximately 35% of the carbonate catalyst entered the thermal decomposition phase, converting the carbonate catalyst ($MgCO_3$) into an oxide (MgO) and releasing carbon dioxide ($CO_2$). Thus, the example in FIG. 6 and Table 1, where the carbonate PCD contained a mixture of 97.29 wt % diamond particles, less than 0.2 wt % Si, and the remaining weight percentage a carbonate catalyst ($MgCO_3$), heat-treated to 1200° C. under vacuum for one hour, approximately 0.97% of the approximately 2.71% of $MgCO_3$ converted to MgO. Accordingly, the addition of the $MgCO_3$ catalyst, according to the details of the example in FIG. 6 and Table 1, at the levels disclosed in Table 1, may not achieve full catalyst decomposition during a post-HPHT sintering heat-treatment temperature below a 1200° C. threshold.

TABLE 1

Phase Content for FIG. 6 X-Ray Diffraction Pattern

| | Diamond | $MgCO_3$ | MgO |
|---|---|---|---|
| Content | 97.29% | 1.75% | 0.97% |

However, by mixing the components of the first, second, and/or third layer with a Si and/or Al compound before sintering, according to various embodiments disclosed herein, full (or nearly full) thermal decomposition of the $MgCO_3$ carbon catalyst during a post-HPHT sintering heat-treatment temperature below 1200° C. may be realized. When the Si and/or Al compound mixed into the first, second, and/or third layer, according to embodiments of the present disclosure, reacts with the $MgCO_3$ catalyst, $MgSiO_3$, $Mg_2SiO_4$, $MgAl_2O_4$ and/or combinations thereof is formed. The compounds formed as a result of the reaction of the Si and/or Al compounds with the $MgCO_3$ promote thermal decomposition of the $MgCO_3$ at a lower temperature than the temperature of thermal decomposition under vacuum during heat-treatment cycles when Si and/or Al is/are not included. According to various embodiments, the $MgCO_3$ will enter the full thermal decomposition phase at or below the 1200° C. threshold for thermal degradation of the carbonate PCD, itself, and thus cause a reduction in the cracks often formed in the carbonate PCD at heat treatment cycles of temperatures between 800° C. and 1200° C. As shown in FIG. 7 and Table 2 below, in some embodiments the $MgCO_3$ of the carbonate PCD containing approximately 1.5 wt % Si (e.g., in the form of SiC), measured using energy dispersive spectroscopy (EDX), and heat-treated to 900° C. under vacuum, entered the full thermal decomposition phase converting to an oxide, $MgSiO_3$, and $Mg_2SiO_4$, while the $MgCO_3$ of the carbonate PCD including with less than 0.2 wt % Si and heat-treated to 900° C. under vacuum did not enter the thermal decomposition phase, and remained in the $MgCO_3$ phase. In the embodiment of FIG. 7, the diamond particles of the first layer were mixed with 1% MgCO3 and 0.5 wt % SiC, and the diamond particles of the second layer were mixed with 3% MgCO3 and 0.5 wt % SiC. The assembly was infiltrated with a third layer containing MgCO3 adjacent to the first layer. After HPHT sintering, the first layer had a thickness of approximately 2.0 mm, and the second layer had a thickness of approximately 6.0 mm, as shown in FIG. 8.

TABLE 2

Phase Content for FIG. 7 X-Ray Diffraction Pattern

| Phase | Diamond | $MgCO_3$ | MgO | $MgSiO_3$ | $Mg_2SiO_4$ |
|---|---|---|---|---|---|
| With <0.2 wt % Si | 97.3% | 2.7% | | | |
| With ~1.5 wt % Si | 96.8% | | 0.45% | 1.38% | 1.2% |

In some embodiments, by increasing the percentage by weight of $MgCO_3$ premixed with the diamond particles of the second layer, or as part of an additional third layer, thermal decomposition of the $MgCO_3$ at a lower temperature is promoted, causing thermal decomposition under vacuum during heat-treatment cycles. The additional percentage by weight of $MgCO_3$ results in the formation of larger pore channels in the carbonate PCD during HPHT sintering, allowing the $CO_2$ gas formed during subsequent thermal decomposition of the $MgCO_3$ to more easily release from the PCD body. As shown in Table 3 below, in one embodiment, the phase ratio of MgO to $MgCO_3$, after heat-treating a carbonate PCD body under vacuum at a temperature of 1100° C. (after HPHT sintering), increases as the percentage by weight of $MgCO_3$ premixed with the diamond particles or as part of a third layer is increased. In one embodiment including a 3% premixed percentage by weight of $MgCO_3$, the phase ratio is approximately 0.07, while in another embodiment including a 5% premixed percentage by weight of $MgCO_3$, the ratio increases to 1.63, and in another embodiment including a 7% premixed percentage by weight of $MgCO_3$, the ratio increases to 13.85.

TABLE 3

Phase Ratio After Heat Treating at 1100° C. for $MgCO_3$ PCD Measured by X-ray Diffraction

| Premixed Amount of $MgCO_3$ | Phase Ratio ($MgO/MgCO_3$) |
|---|---|
| 3% | 0.07 |
| 5% | 1.63 |
| 7% | 13.85 |

However, an increase in the percentage by weight of $MgCO_3$ premixed into a layer, while promoting thermal decomposition of the catalyst at a lower temperature, can also decrease the wear resistance of the PCD body surface as a result of the formation of larger pore channels on the surface carbonate PCD body and as a result of the decrease in diamond density. In various embodiments, the increased percentage by weight of $MgCO_3$ is added to the second layer, and/or as part of the additional third layer, while the first layer, which will form a working surface of the carbonate PCD, optionally includes a comparably decreased percentage by weight of $MgCO_3$. As a result of the increased percentage by weight of $MgCO_3$ premixed into the second and/or third layers, these layers may be generally thicker than the first layer, which contains a lesser quantity of the $MgCO_3$ premixed into the layer. In these embodiments, the higher concentration of the $MgCO_3$ catalyst premixed into the second and/or third layers may promote thermal degradation of the $MgCO_3$ catalyst at a lower temperature than the temperature at which thermal degradation of the $MgCO_3$ of the first layer will occur because of the formation of larger pore channels in the second and/or third layers due to the higher concentration of the $MgCO_3$ catalyst, making it easier for $CO_2$ gas to be released from these layers. Accordingly, in some embodiments, the $MgCO_3$ catalyst in the second and/or third layers, which will be heat-treated after HPHT sintering, may be more fully decomposed at a lower temperature than the $MgCO_3$ catalyst in the first layer. The result of this variance in thermal decomposition properties of the layers after HPHT sintering and initial heat-treatment cycles due to the difference in the $MgCO_3$ catalyst concentrations in the layers is that the carbonate PCD may form minimal to no cracks at the working surface side of the first layer during subsequent heat-treatment cycles because the $CO_2$ decomposed from the first layer can be quickly released through the thinner first layer, rather than remain trapped inside the thicker second and/or third layers. However, because the Si and/or Al compounds may promote thermal decomposition of the $MgCO_3$ catalyst at a lower temperature are not catalysts, in order to decrease wear resistance at the working surface, the amount of these compounds that accumulates at the working surface after mixing these Si and/or Al compounds into the first, second, and/or third layer, in some embodiments, may be minimized or reduced. In some embodiments, infiltrating the first layer at the working surface side with additional $MgCO_3$ catalyst that has not been premixed with diamond particles, for example by placing the third layer or another fourth layer of $MgCO_3$ catalyst adjacent to the first layer so that the first layer is sandwiched between the third or fourth layer and the second layer, allows for the formation of a working surface with minimal cracks, and maintained wear resistance. In some embodiments, after HPHT sintering and subsequent heat-treatment cycles, the additional $MgCO_3$ catalyst in the third or fourth layer, adjacent to the first layer, may fully decompose, allowing the Si and/or Al compound to infiltrate through the remaining layers, and resulting in the formation of a working surface having reduced to no cracks.

Figure 4:
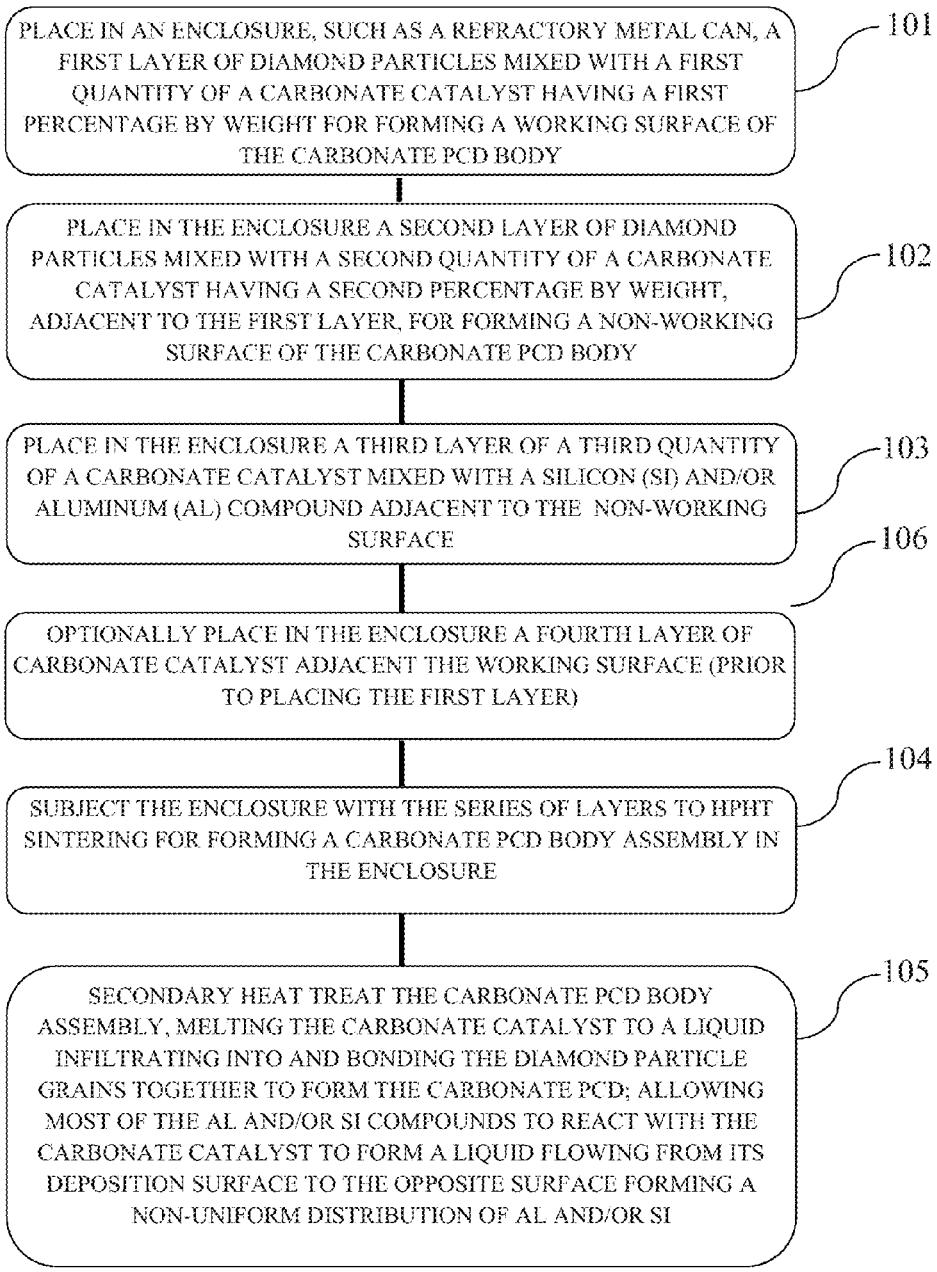
FIG. 4 is a flowchart illustrating a method of forming a carbonate polycrystalline diamond body incorporating a distribution of a Si and/or Al compound, according to an embodiment.

A method for forming the carbonate PCD body with a distribution of Si and/or Al elements is shown in FIG. 4 with additional reference to FIG. 2, according to one embodiment. The method includes placing in an enclosure a first layer 22 of diamond particles mixed with a first quantity of a carbonate catalyst having a first percentage by weight for forming a working surface 23 of the carbonate PCD body 20 (block 101). In some embodiments, the first percentage by weight of the carbonate catalyst is approximately 1.0 wt % (with respect to the weight of the first layer). In other embodiments, the first percentage by weight of the carbonate catalyst is approximately 0.5-3.0 wt % (with respect to the weight of the first layer) and the first layer has a thickness of approximately 1-3 mm. Then, a second layer 24 of diamond particles mixed with a second quantity of a carbonate catalyst having a second percentage by weight may be placed adjacent to the first layer 22, for forming a non-working surface 21 of the carbonate PCD body (block 102). The second layer 24 includes a second percentage by weight of the carbonate catalyst that is greater than the first percentage of the first layer 22, such that the non-working surface 21 contains a greater carbonate catalyst composition than the working surface 23. In other embodiments, the second percentage of the carbonate catalyst is the same as the first percentage of the carbonate catalyst. As a result of the reduced quantity of the carbonate catalyst compound in the first layer 22 (block 106) in the embodiment where the second percentage of the carbonate catalyst is greater than the first percentage, the first layer 22 may be infiltrated from the working surface side 23 with an additional layer of carbonate catalyst prior to HPHT sintering. Thus, in some embodiments, a layer of carbonate catalyst is placed adjacent to the working surface side 23 of the first layer 22 (block 106). In some embodiments, the second percentage of the carbonate catalyst is greater than 1.0 wt % (with respect to the weight of the second layer). In some embodiments, the second percentage of the carbonate catalyst is 5.0 wt % (with respect to the weight of the second layer). In other embodiments, the second percentage of the carbonate catalyst is 7.0 wt % (with respect to the weight of the second layer). In some embodiments, the second percentage by weight of the carbonate catalyst is approximately 2.0-9.0 wt % (with respect to the weight of the second layer) and the second layer has a thickness of approximately 3-15 mm. In some embodiments, the first layer has a first percentage of the carbonate catalyst that is greater than 1.0 wt % (with respect to the weight of the first layer).

In some embodiments, the method includes introducing a third layer 26 including a Silicon (Si) and/or Aluminum (Al) compound, as well as a carbonate catalyst adjacent to the non-working surface 21 of the second layer (block 103). In various embodiments, this Si and/or Al compound includes Al, Si, $SiO_2$, $Al_2O_3$, SiC, $Al_3C$, and/or combinations thereof.

In some embodiments, the Si and/or Al compound is included at about 1.5 wt % (with respect to the weight of the carbonate catalyst). In other embodiments, the Si and/or Al compound is SiC included at 0.5 wt % (with respect to the weight of the layer). In other embodiments, instead of using a third layer, the Si and/or Al compound can be combined directly with the second layer 24 forming a mixture of diamond particles, mixed with the second percentage of carbonate catalyst, and mixed with the Si and/or Al compound for forming the second layer 24. In other embodiments, the Si and/or Al compound is introduced to the separate third layer 26, the Si and/or Al compound is applied as separate layer 29 adjacent to the second layer 24, and disposed at an opposite surface from the first layer working surface 23, and adjacent to the non-working surface 21, as, for example, shown in FIG. 2*c*. In some embodiments, the third layer 26 also includes a third percentage by weight of the carbonate catalyst combined with the Si and/or Al compound. In some embodiments, the Si and/or Al compound is a Si compound, such as $SiO_2$, having a percentage by weight of 1.5% wt (based on the weight of the carbonate catalyst used) of the third layer. In other embodiments, the Si and/or Al compound can be combined directly with the first layer of diamond particles mixed with the first percentage of carbonate catalyst to form the first layer 22 or working surface 23, and thus, a third layer may not be required. In other embodiments, the Si and/or Al compound can be combined directly with the third layer 26 including the carbonate catalyst placed adjacent to the working surface 23 side of the first layer 22 prior to HPHT sintering. In other embodiments, the second layer 24 can include multiple layers, including layers of varying compositions, catalyst types and volumes, and/or thicknesses.

In other embodiments, as shown in FIG. 3*b*, a substrate 27 is provided adjacent to the second layer 24 (FIG. 3*b*), e.g., adjacent to the non-working surface 21 of the second layer 24. When a third layer is included, the substrate 27 may be provided adjacent to the third layer 26. In some embodiments, the substrate is useful for attaching the carbonated PCD body to a cutting tool. The substrate may also provide a source of a solvent metal catalyst such as cobalt. The substrate can be selected from the group including metallic materials, ceramic materials, cermet materials, and/or combinations thereof. Examples of suitable substrates include carbides such as WC, $W_2C$, TiC, VC, and SiC. In some embodiments, the substrate is formed of cemented tungsten carbide.

With reference again to FIG. 4, after placing the series of layers 22, 24, and 26, in the container, the method includes subjecting the container 28 (having the series of layers) to HPHT sintering (block 104). In some embodiments, the third layer 26 is adjacent to the first layer 22, sandwiching the first layer 22 between the third layer 26 and the second layer 24. HPHT sintering according to various embodiments includes sintering to a temperature 1350° C. or greater and a pressure of about 5 GPa or 50 kbar or greater. In some embodiments, the method includes HPHT sintering at a temperature greater than 1800° C. and a pressure of about or greater than 6.5 GPa or 65 kbar. At this HPHT sintering temperature, the carbonate catalyst at each layer melts, entering the liquid phase, and infiltrating into the diamond particles of the first and second layers, catalyzing the bonding of the diamond particles grains together to form the carbonate PCD (block 105), as also shown in FIG. 3*a*. Also at this HPHT sintering temperature, most of the Si and/or Al compounds, including SiC and/or $Al_2O_3$, will react with the carbonate catalyst to form a liquid. The liquid will flow in the general direction of liquid flow, from the surface where it was deposited to the opposite surface (block 105). In some embodiments, where the Si and/or Al compound is directly mixed with the particles and catalyst of the second layer or includes a separate third layer adjacent to the second layer prior to HPHT sintering, the Si and/or Al rich liquid flows toward the first layer and/or the first layer working surface during HPHT sintering. In other embodiments, the Si and/or Al compound is directly mixed with the particles and catalyst of the first layer prior to HPHT sintering, and the Si and/or Al rich liquid flows toward the second layer or non-working surface during HPHT sintering. As a result of the differential percentages by weight of carbonate catalyst at each of the first and second layers, and as a result of the flow of the Si and/or Al rich liquid after HPHT sintering to the opposite surface from its disposition location prior to HPHT sintering, the working surface and non-working surface sides of the carbonate PCD body have different thermal decomposition behaviors. Some portion of the Si and/or Al compound may remain in the layer in which it was introduced.

By way of example, FIG. 8 shows the distribution of Si along the thickness of a PCD body after HPHT sintering according to one embodiment including a 0.5 wt % SiC compound (based on the weight of the layer) mixed with diamond particles in both a first and a second layer of the carbonate PCD body. As shown in FIG. 8, the entire carbonate PCD body has a thickness of approximately 8 millimeters (mm) as measured from the non-working surface. The SiC compound was originally mixed in with the diamond particles and $MgCO_3$ catalyst in both the first layer and the second layer. In this example, the first layer diamond particles were mixed with 1 wt % $MgCO_3$ and 0.5 wt % SiC (both based on the total weight of the layer), and the second layer diamond particles were mixed with 3 wt % $MgCO_3$ and 0.5 wt % SiC (both based on the total weight of the layer). A layer of $MgCO_3$ was also introduced at the working surface side of the first layer to infiltrate the first layer with $MgCO_3$. During HPHT sintering, the SiC compound reacted and melted, and the resulting Si liquid flowed to the opposite surface across the 8 mm thickness of the PCD body, mostly accumulating at a depth between 0.0 mm to 4.0 mm, where the depth is measured from the non-working surface such that the working surface is at a 8 mm depth and the non-working surface is at 0.0 mm depth. After sintering, the first layer had a thickness of approximately 2.0 mm, and the second layer had a thickness of approximately 6.0 mm.

FIG. 9 shows another example of the distribution of Si along the thickness of a PCD body after HPHT sintering according to other embodiments including $MgCO_3$ containing a 1.5 wt % $SiO_2$ compound (based on the weight of the $MgCO_3$). In this example, the diamond particles of the first layer were mixed with 1 wt % $MgCO_3$ containing 1.5 wt % $SiO_2$, while the diamond particles of the second layer were mixed with 5 wt % $MgCO_3$ containing 1.5 wt % $SiO_2$. A layer of $MgCO_3$ was also introduced at the working surface side of the first layer to infiltrate the first layer with $MgCO_3$. After HPHT sintering, the first layer had a thickness of approximately 2.5 mm (where the first layer is shown in FIG. 9 ranging from 11.5 mm to 14 mm in depth) and the second layer had a thickness of approximately 11.5 mm (where the second layer is shown in FIG. 9 ranging from 0 mm to 11.5 mm in depth). As a result of the 1.5 wt % $SiO_2$ in the $MgCO_3$, a non-uniform Si distribution was detected after HPHT sintering. However, most of the Si element accumulated along the second layer.

Figure 10:
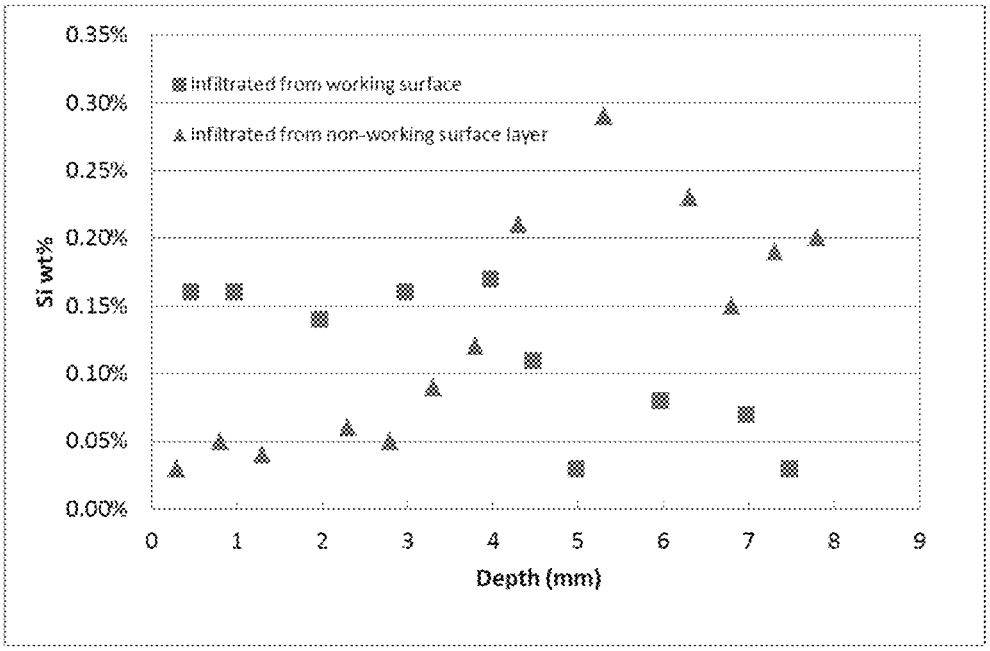
FIG. 10 is a graph comparatively demonstrating the distribution of Silicon along the thickness of a PCD body including an $MgCO_3$ catalyst infiltrating the assembly from the second layer of the PCD body versus from the first layer of the PCD body, according to an embodiment.

FIG. 10 shows another example of the distribution of Si along a thickness of a PCD body after HPHT sintering, showing an embodiment where an additional layer of $MgCO_3$ was introduced at the working surface side, and an embodiment where an additional $MgCO_3$ layer was introduced at the non-working surface side. The diamond particles of the first layer were mixed with 1 wt % $MgCO_3$ (based on the total weight of the first layer) and the first layer had a thickness of approximately 2 mm. The diamond particles of the second layer were mixed with 3 wt % $MgCO_3$ (based on the total weight of the second layer) and the second layer had a thickness of approximately 6 mm. One sample was infiltrated with $MgCO_3$ from the working surface side and the other sample was infiltrated from the non-working surface side. The resulting Si distribution was different in each embodiment. When the $MgCO_3$ layer was infiltrated from the working surface side, the Si level was high at the second layer, but where the $MgCO_3$ layer was infiltrated from the non-working surface side, the Si level was high at the first layer. Accordingly, to improve the wear resistance at the working surface side, the additional $MgCO_3$ layer may be infiltrated from the working surface side.

In some embodiments, where the Si and/or Al compound is directly mixed with the particles and catalyst of the second layer or in the separate third layer adjacent to the second layer prior to HPHT sintering, the resulting carbonate PCD after HPHT sintering has a first layer or working surface with a higher concentration of the Si and/or Al compound. And, as a result of the first layer including the working surface having a percentage of the carbonate catalyst less than that of the second layer prior to HPHT sintering, a greater percentage of the carbonate catalyst may be thermally decomposed at the first layer working surface, than at the second layer or non-working surface, during heat-treatment cycles. The higher concentration of the Si and/or Al compound formed at the first layer including the working surface results in a lower thermal decomposition temperature for the carbonate catalyst than there would be otherwise without the Si and/or Al compound at the working surface and throughout the remainder of the carbonate PCD, including throughout the second layer. In other embodiments, the decomposition temperature of the first layer may be lower than, equal to, or even greater than the decomposition temperature of the second layer, as a result of the Si and/or Al compound introduced prior to HPHT sintering. However, the resulting thermal decomposition temperature of the first layer will be less than the thermal decomposition temperature for a carbonate catalyst not including a Si and/or Al compound. The result is a diamond compact including a carbonate PCD body with a distribution of Si and/or Al elements.

A diamond compact 30 according to an embodiment is shown in FIGS. 3*a* and 3*b*. The diamond compact 34 includes a carbonate PCD body having a first layer 22 including a working surface 23, a second layer 24 including a non-working surface 21, and an optional substrate 27 (shown in FIG. 3*b*). The diamond compact 34 is more thermally stable, and is able to operate at elevated temperatures without experiencing cracking (or experiencing less cracking) caused by the thermal decomposition of the PCD during heat treatment cycles between 800° C. and 1200° C.

The diamond compact 30 shown in FIGS. 3*a* and 3*b* is formed as a cutting element for incorporation into a cutting tool such as, for example, a drill bit or a drag bit. FIG. 5 shows a drag bit 40 incorporating the cutting element of FIG. 3*a* or 3*b*, according to embodiments of the disclosure. The drag bit 40 may include several cutting elements 30 that are each attached to blades 32 that extend along the drag bit. The drag bit may be used for high-temperature rock drilling operations. In other embodiments, other types of drilling or cutting tools include for example, rotary or roller cone drilling bits, percussion or hammer drill bits, or hole openers or reamers, may be utilized. In some embodiments, the cutting element is a shear cutter.

In other embodiments, rather than the carbonate catalyst, and/or the Si and/or Al compounds being mixed in or pre-mixed with the diamond particles of the first layer, and/or the second layer, the carbonate catalyst and/or the Si and/or Al compounds may be applied as separate layer(s) adjacent to the first layer or the second layer, or the third layer, or any other layer including or not including diamond particles. The separate layer(s) including the carbonate catalyst and/or the Si and/or Al compounds may then infiltrate into the corresponding adjacent layer during HPHT sintering.

Although only a few embodiments have been described in detail above, those skilled in the art will readily appreciate that many modifications are possible in the embodiments without materially departing from embodiments disclosed herein. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A carbonate polycrystalline diamond body having a working surface opposite a non-working surface, the carbonate polycrystalline diamond body comprising:

a first layer comprising a material microstructure comprising a plurality of bonded-together diamond crystals and interstitial spaces there between, a portion of the interstitial spaces being occupied by a first quantity of magnesium carbonate, the first layer defining the working surface, and at least a portion of the interstitial spaces being occupied by a quantity of silicon.

2. The carbonate polycrystalline diamond body of claim 1, further comprising a second layer adjacent to the first layer at a location opposite the working surface, the second layer comprising a material microstructure comprising a plurality of bonded-together diamond crystals and interstitial spaces there between, a portion of the interstitial spaces being occupied by a second quantity of magnesium carbonate equal to or greater than the first.

3. The carbonate polycrystalline diamond body of claim 2, wherein the second layer comprises a majority of the quantity of silicon.

4. The carbonate polycrystalline diamond body of claim 1, wherein the carbonate polycrystalline diamond body is formed by high pressure high temperature sintering.

5. The carbonate polycrystalline diamond body of claim 4, wherein the first layer is formed by mixing a first quantity of diamond particles with a first quantity of magnesium carbonate.

6. The carbonate polycrystalline diamond body of claim 5, wherein the carbonate polycrystalline diamond body is heat treated after the high pressure and high temperature sintering, causing at least a portion of the magnesium carbonate to decompose into an oxide, resulting in a non-uniform distribution of the oxide through the first layer, wherein the working surface with a different thermal decomposition behavior than the non-working surface.

7. The carbonate polycrystalline diamond body of claim 1, wherein the carbonate polycrystalline diamond body has a non-uniform distribution of the silicon, wherein the working surface has a different thermal decomposition behavior than the non-working surface.

8. The carbonate polycrystalline diamond body of claim 1, wherein the silicon includes at least one selected from the group consisting of silicon, silicon dioxide, silicon carbide, and combinations thereof.

9. The carbonate polycrystalline diamond body of claim 1, wherein the carbonate polycrystalline diamond body further comprises a substrate adjacent to the non-working surface.

10. The carbonate polycrystalline diamond body of claim 1, wherein the first layer further comprises about 1.5 wt % silicon based on the total weight of the magnesium carbonate in the first layer.

11. The carbonate polycrystalline diamond body of claim 1, wherein the first layer further comprises a material selected from the group consisting of $MgSiO_3$, $Mg_2SiO_4$, $MgAl_2O_4$, and combinations thereof.

12. The carbonate polycrystalline diamond body of claim 2, wherein the first layer or the second layer comprises about 0.5 wt % SiC based on the total weight of the respective layer.

13. The carbonate polycrystalline diamond body of claim 1, wherein the first layer further comprises aluminum.

* * * * *